US005141345A

United States Patent [19]

Kosugi et al.

[11] Patent Number: 5,141,345

[45] Date of Patent: Aug. 25, 1992

[54] SHEET DISCHARGE APPARATUS FOR PRINTER

[75] Inventors: Kimihiro Kosugi, Iruma; Michio Koizumi, Tokorozawa; Takashi Sawada, Sayama; Seiji Morita, Hoya; Kouzou Abe, Tokyo, all of Japan

[73] Assignee: Citizen Watch Co., Ltd., Tokyo, Japan

[21] Appl. No.: 685,053

[22] Filed: Apr. 15, 1991

[51] Int. Cl.[5] ..... B41J 11/50

[52] U.S. Cl. ..... 400/605; 400/625

[58] Field of Search ..... 400/625, 605, 624, 626, 400/627, 628, 629; 271/3, 3.1, 10, 118, 209

[56] References Cited

U.S. PATENT DOCUMENTS

| | | | |
|---|---|---|---|
| 1,213,189 | 1/1917 | Hart . | |
| 2,517,147 | 8/1950 | Vee . | |
| 4,262,894 | 4/1981 | Marano | 271/118 |
| 4,420,149 | 12/1983 | Schultes et al. | 271/10 |
| 4,577,984 | 3/1986 | Yamamoto et al. | 400/605 |
| 4,657,420 | 4/1987 | Kondo | 400/628 |
| 4,767,114 | 8/1988 | Nishimoto | 271/209 |
| 4,778,168 | 10/1988 | Kashimura et al. | 400/605 |
| 4,854,757 | 8/1989 | Kikuchi | 400/605 |

FOREIGN PATENT DOCUMENTS

| | | |
|---|---|---|
| 62-59058 | 3/1987 | Japan . |
| 63-43751 | 3/1988 | Japan . |
| 1-115559 | 8/1989 | Japan . |

*Primary Examiner*—Eugene H. Eickholt

*Attorney, Agent, or Firm*—Lowe, Price, LeBlanc & Becker

[57] ABSTRACT

A sheet discharge apparatus for a printer comprising a platen, a first discharge roller unit movable toward and away from the platen and defining a first sheet insertion passage at a location between the platen and the first discharge roller unit, an openable and closable top cover, a second discharge roller unit mounted for longitudinal movement in parallel relation to the top cover, to define a second sheet insertion passage at a location between the first discharge roller unit and the second discharge roller unit, and positioning means for the second discharge roller unit, which is provided on the printer body.

10 Claims, 5 Drawing Sheets

VII
1
2
3
4
5
6
7
8
9
10
11
11'
12
13
14
15
16
17
18
19
22
23
25
28
29
30
31
32

SHEET DISCHARGE APPARATUS FOR PRINTER

BACKGROUND OF THE INVENTION

The present invention relates to a sheet discharge apparatus for a printer.

The applicant of the present invention has previously proposed a printer in which a sheet delivery or transporting path is defined between a guide rib mounted to a top cover and a discharge roller unit mounted to a printer body in parallel relation to a platen (refer to Japanese Utility Model Laid-Open No. 115559/1989 and Japanese Utility Model Laid-Open No. 43751/1988).

However, the printers disclosed in these publications are arranged as follows. That is, as shown in FIG. 4 of the attached drawings, papers or sheets can easily be mounted when the sheets are fed out upwardly by a push system. As shown in FIG. 5, however, in the case where the sheets are pulled or drawn rearwardly by a push-pull system, or as shown in FIG. 6, in the case where the sheets are fed in from the below and are drawn rearwardly by a pull system, the sheets must be passed through a narrow gap between the roller unit and the platen. Accordingly, the discharge roller unit stands in the way of the operation so that it is difficult to set the sheets.

SUMMARY OF THE INVENTION

It is an object of the invention to provide a sheet discharge apparatus for a printer having a sheet mounting device of a push-tractor system or of a pull-tractor system, in which mounting and demounting of sheets are easy.

A sheet discharge apparatus for a printer, according to the invention comprises a printer body provided with a platen, a first discharge roller unit mounted to said printer body for defining a first sheet insertion passage at a location between said first discharge roller unit and said platen, a top cover mounted to said printer body for movement between open and closed positions, and a second discharge roller unit mounted to said top cover for defining a second sheet insertion passage at a location between said first discharge roller unit and said second discharge roller unit, wherein a gap between the first discharge roller unit and the platen is capable of being altered.

In order to regulate or adjust shift in position of the second discharge roller unit during opening and closing of the printer body and the top cover, the second discharge roller unit is mounted for longitudinal movement in parallel to the top cover, and positioning means for the second discharge roller unit is provided on the printer body.

When the sheets are fed out upwardly by the push-tractor system, the sheets passed through the front face of the platen are automatically fed into a location between the first and second discharge roller units. When the sheets are fed out rearwardly by the pull-tractor system, the first discharge roller unit is moved to enlarge the gap between the platen and the first discharge roller unit, and a leading end of the sheet is inserted into a location between the first discharge roller and the platen. Further, after the top cover has been moved to the closed position, the second discharge roller unit is moved, and is held or retained at a position proper or appropriate with respect to the first discharge roller unit by the positioning means.

According to the invention, at sheet mounting for feeding out the sheets rearwardly, the gap between the first discharge roller unit and the platen is enlarged so that the sheets can easily be set.

Furthermore, it is possible to move the second discharge roller unit to an appropriate position by means of opening and closing movement of the top cover, to position the second discharge roller unit. Thus, the sheets can reliably be fed out.

DETAILED DESCRIPTION

Figures 1, 8:
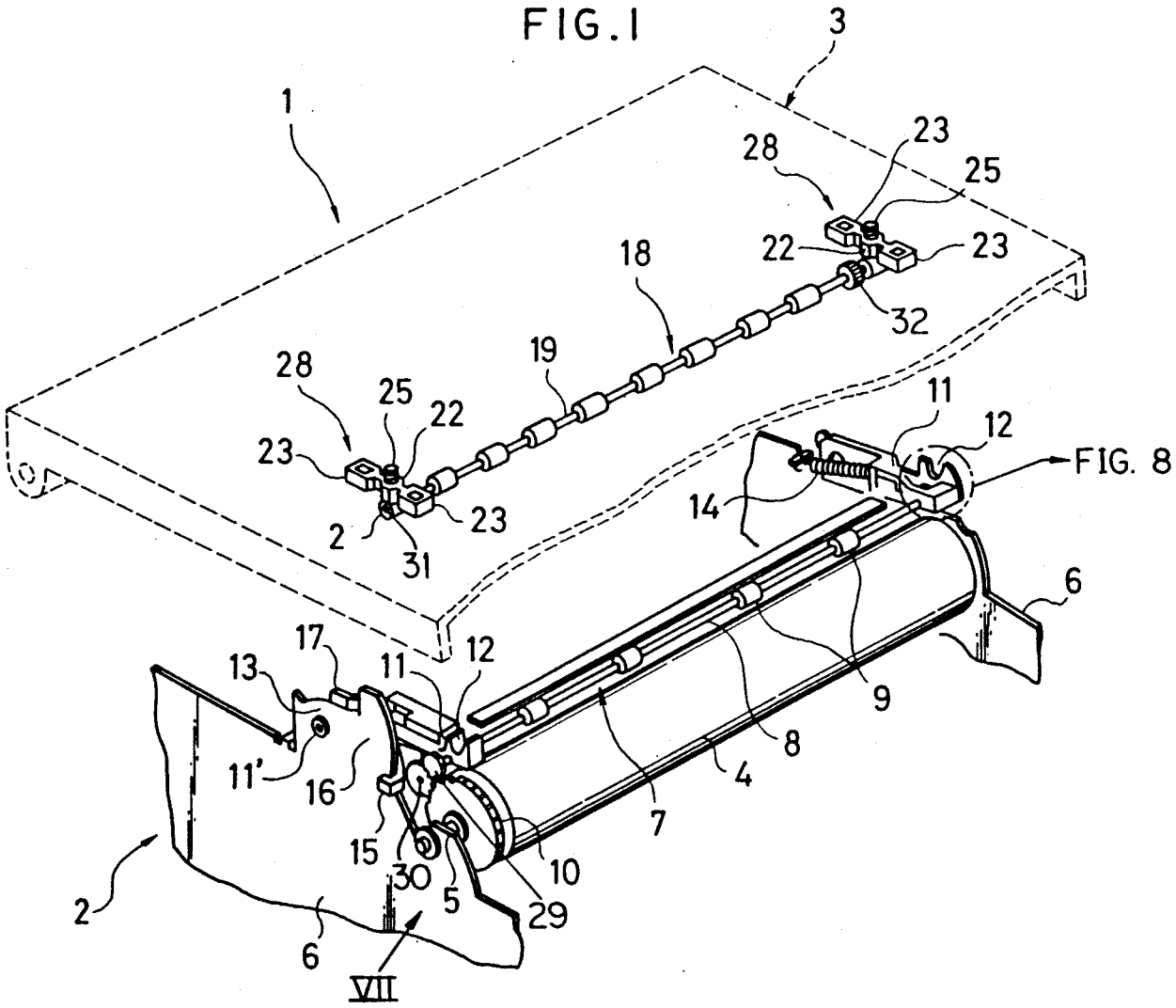
FIG. 1 is a perspective view of a sheet discharge apparatus of a printer, showing an embodiment of the invention.
FIG. 8 is an enlarged perspective view of one end of pivot shaft 8.
Figure 3:
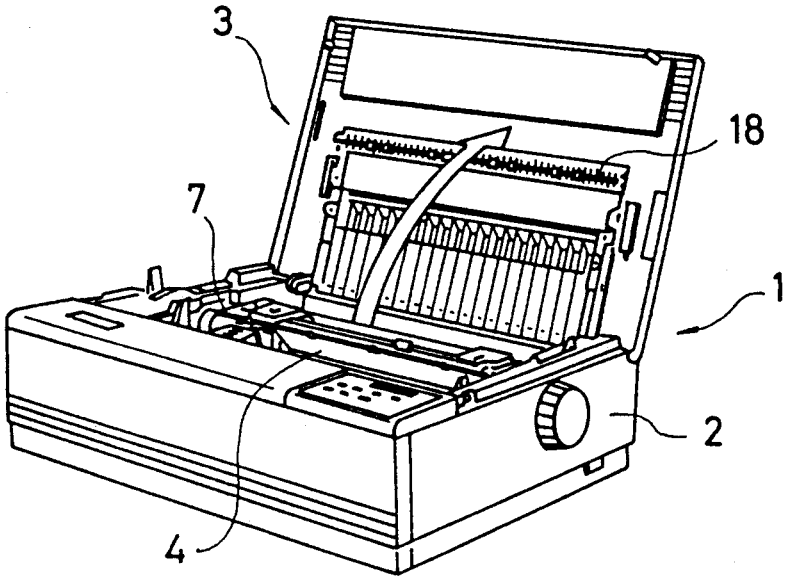
FIG. 3 is a perspective view of the entire printer.

Referring first to FIG. 3, there is shown a printer 1 which comprises a box-like printer body 2, and a top cover 3 mounted to an upper face of the printer body 2 for movement between open and closed positions. The printer body 2 has an elongated cylindrical platen 4 which is fixedly mounted to a rotary shaft 5 in unision, as shown in FIG. 1. The rotary shaft 5 extends horizontally and has its both ends which are rotatably mounted to a pair of side walls 6 and 6 of a frame of the printer body 2.

A pair of discharge-roller support arms 11 and 11 are supported respectively at upper ends of the respective side walls 6 and 6 so as to be rotatable by means of an arm shaft 11'. A first discharge roller unit 7 is rotatably mounted between free ends of the respective discharge roller arms 11 and 11.

A gear 29, which is arranged at one end of first discharge roller unit 7, is in mesh with an intermediate gear 30 which in turn engages a gear 10 provided at one end of platen 4. The gearing is such that first discharge roller 7 is rotated in the same direction as, and in synchronism with, platen 4, roller 7 having a peripheral speed slightly higher than that of platen 4.

The first discharge roller unit 7 comprises a pivot shaft 8 extending in parallel relation to the platen 4 and a plurality of discharge rollers 9 which are fixedly mounted to the pivot shaft 8 in unison with a space defined between the discharge rollers 9 and the pivot shaft 8. A unidirectional clutch (not shown) is arranged between the pivot shaft 8 and gear 29. The unidirectional clutch is brought to its engaged position to drive roller unit 7 only when the platen 4 is rotated in a sheet advancing direction.

A pair of semicircular recesses 12 and 12, which serve as positioning means for a second discharge roller unit 18 to be described subsequently, are formed respectively in upper sides of the respective discharge-roller support arms 11 and 11 adjacent to their forward ends. A pair of projections 17 and 17, which are abutted respectively against upper ends of stopper sections 13 and 13 formed respectively at upper portions of the side walls 6 and 6, are provided respectively at outer faces of rear sections of the discharge-roller support arms 11 and 11. A hook element 15 is provided at the outer face of at least one of the pair of discharge-roller support arms 11.

Figure 7:
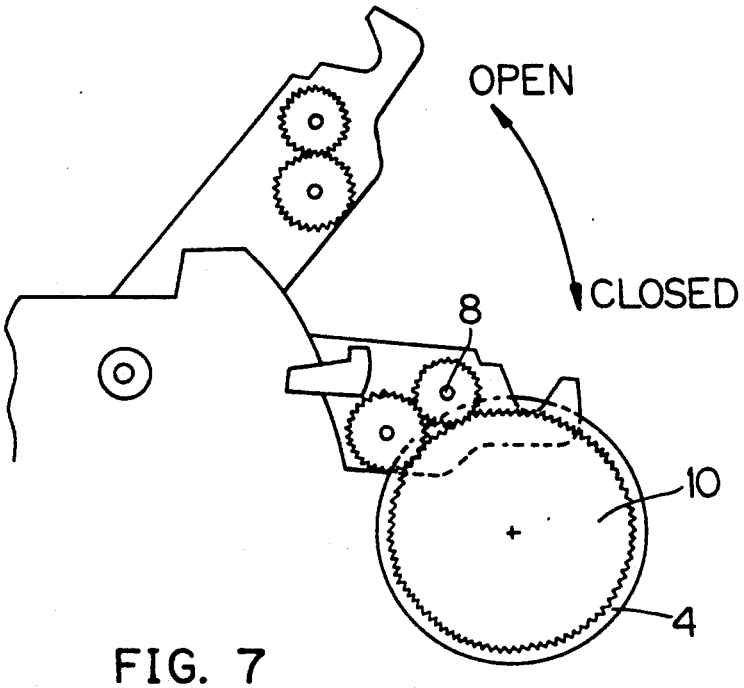
FIG. 7 is a partial side view of the discharge apparatus of FIG. 1 in open and closed positions.
Figure 8:
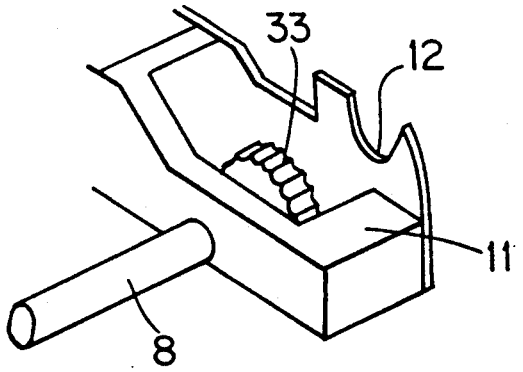

A guide section 16, which is curved in a convex manner outwardly, is provided at at least one of the pair of side walls 6 of the printer body 2. The hook element 15 is engaged with the guide section 16 to prevent the first discharge roller unit 7 and the discharge-roller support arm 11 from being moved in an axial direction (FIG. 7). A pair of springs 14 and 14 are arranged respectively between the discharge-roller support arms 11 and 11 and the side walls 6 and 6, for moving the discharge-roller support arms 11 and 11 in such a direction that the first discharge roller unit 7 moves away from the platen 4, when the top cover 3 is moved to its open position.

Further, the arrangement is such that, when the first discharge roller unit 7 is moved upwardly, the projections 17 and 17 of the respective discharge-roller support arms 11 and 11 are abutted respectively against upper ends of the stopper sections 13 and 13 of the respective side walls 6 and 6 and are restricted in position, so that a space of about 40 mm is defined between the outer face of the platen 4 and the outer faces of the rollers 9 of the first discharge roller unit 7.

A second discharge roller unit 18, which comprises a pivot shaft 19 extending in parallel relation to the platen 4 and a plurality of discharge rollers 20 fixedly mounted to the pivot shaft 19, are rotatably arranged at the lower face of the top cover 3.

The plurality of rollers 20 are so arranged as to be located one by one at left- and right-hand sides of the roller 9 in the first discharge roller unit. A gear 32 (FIG. 8) is provided at one end of the pivot shaft 19 and is in mesh with gear 33 provided at a corresponding end of pivot shaft 8.

Figure 2:
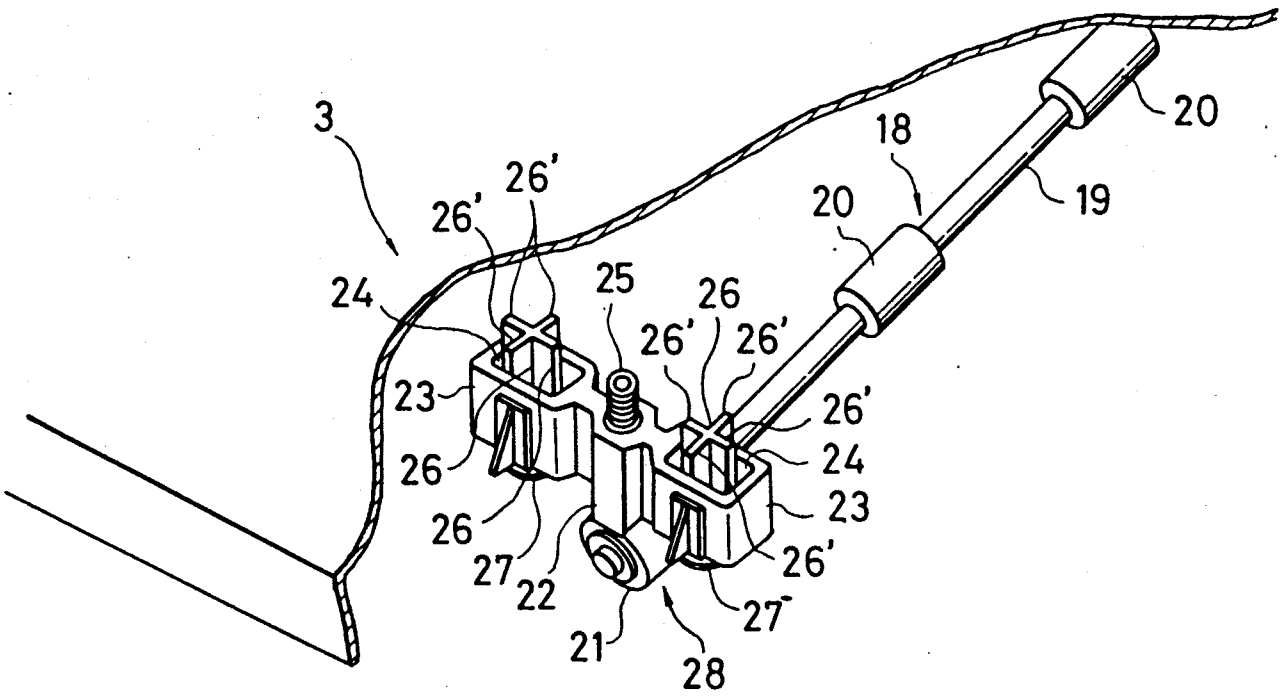
FIG. 2 is an enlarged perspective view of a principal portion of the printer illustrated in FIG. 1.

Furthermore, as shown in FIG. 2, a pair of positioning elements 28 and 28 are mounted respectively at both ends of the pivot shaft 19 and comprise cylindrical sections 21 and 21, longitudinal tubular sections 22 and 22 and fitting sections 23 and 23 at both sides of the longitudinal tubular sections 22 and 22, respectively.

The pair of cylindrical sections 21 and 21 are larger in diameter than the pivot shaft 19, and are mounted respectively to the ends of the pivot shaft 19. Each of the longitudinal tubular sections 22, which has an open upper position, is provided on the upper face of the corresponding cylindrical section 21. The pair of fitting sections 23 and 23 are provided respectively in front of and in rear of each of the longitudinal tubular sections 22. The cylindrical section 21 is fitted in the recess 12 of the first discharge roller unit 7. Sliding bores 24 and 24, which are long in the longitudinal direction as compared with the widthwise direction and which open vertically, are formed respectively in the fitting sections 23 and 23. Coil springs 25 and 25 are fitted respectively about the longitudinal tubular sections 22 and 22 so as to project upwardly.

Moreover, a pair of guide elements 26 and 26 are provided in an upstanding manner on the rear face of the top cover 3 so as to be located at both ends of the second discharge roller unit 18.

Each of the guide elements 26 has its upper section which is cruciform in cross-section provided with ribs 26' at four sides or directions. The guide section 26 has a portion extending in parallel relation to the pivot shaft 19, whose width is identical in length with that of a corresponding one of the slide bores 24. The ribs 26' extending in a direction perpendicular to the pivot shaft 19 extend perpendicularly to the slide bores 24. The guide elements 26 and 26, which are arranged longitudinally, have their respective forward ends a distance between which is substantially identical with that between the forward ends of the slide bores 24 of the pair of longitudinal fitting sections 23 and 23. The guide section 26 has its longitudinal width which is slightly smaller than the slide bore 24. The positioning element 28 is slightly movable in the longitudinal direction with respect to the guide element 26. Further, female threads (not shown) are provided at the lower end of the guide element 26.

The slide bore 24 in the fitting section 23 is fitted about guide element 26 from the below. A bolt 27 is inserted through the guide element 26 from a location further below the slide bore 24. The bolt 27 has its forward end which is threadedly engaged with the female threads of the guide element 26. The second discharge roller unit 28 is mounted to the rear face of the top cover 3 so as to compress the coil spring 25.

Under this condition, a gap extending in the longitudinal direction is defined between the inner wall of the slide bore 24 in the fitting section 23 and the guide element 26. Furthermore, the second discharge roller unit 18 is held or retained under such a condition as to slightly float from the rear face of the top cover 3 under the biasing force of the coil spring 25. Accordingly, the second discharge roller unit 18 can slightly be moved longitudinally in parallel relation to the top cover 3. The projection 21 is fitted in the recess 12 so that the second discharge roller unit 18 is located at a proper or appropriate position with respect to the first discharge roller unit 7.

Figure 5:
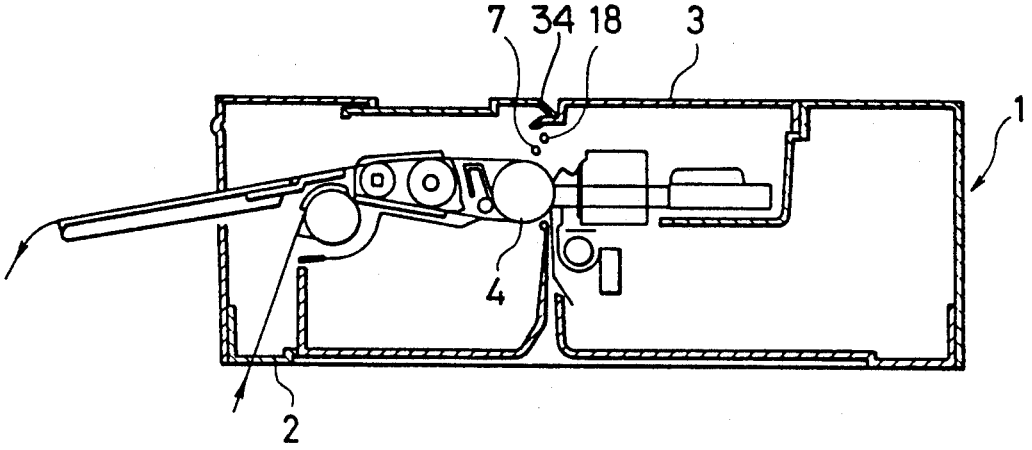
Figure 6:
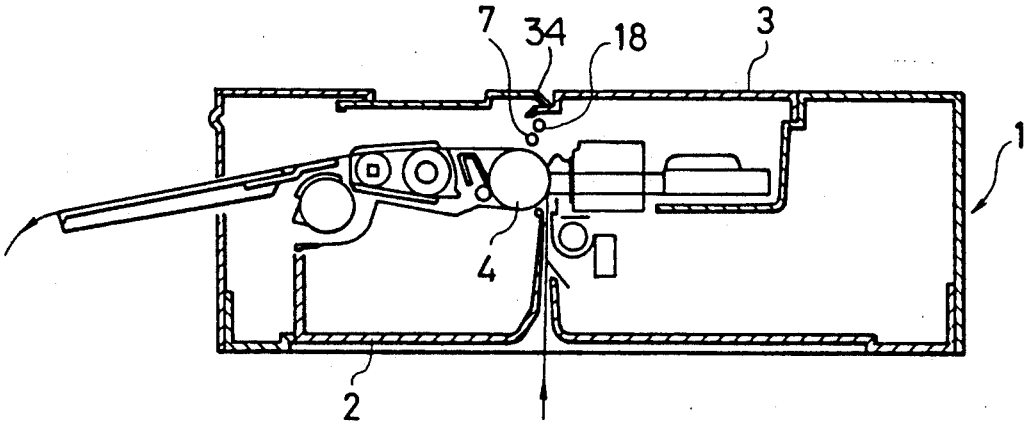

A mounting procedure of sheets with respect to the printer 1 will next be described. When the sheets are fed out rearwardly, movement of sliding door 34 of the top cover 3 to the open position enables the first discharge roller unit 7 to be angularly moved upwardly under the force of the spring 14 which is applied to the discharge-roller support arm 11, so that the gap between the first discharge roller 7 and the platen 4 is enlarged. Under this condition, the sheet rests on the upper face of the platen 4, and sliding door 34 of top cover 3 is moved to the closed position. Then, the first discharge roller unit is pushed downwardly against the biasing force of the spring 14, and the hook element 15 slides downwardly. The first discharge roller unit 17 is moved downwardly until the projection 17 is abutted against the stopper section 13. Thus, as shown in FIGS. 5 and 6, the sheet is mounted to a first sheet insertion passage which is defined between the first discharge roller unit 7 and the platen 4.

Figure 4:
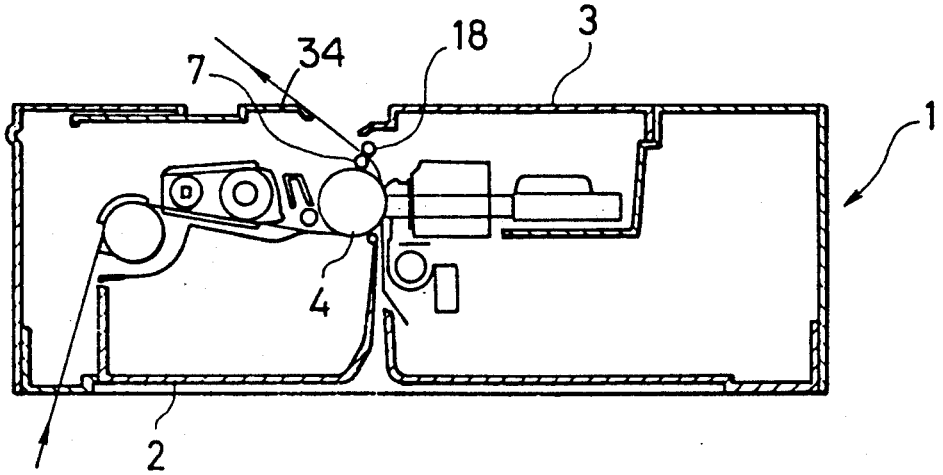
FIGS. 4 through 6 are longitudinal cross-sectional views of the printer, respectively showing flow of another sheets.

In the case where the sheets are fed out upwardly as shown in FIG. 4, with sliding door 34 open, the sheets are automatically set in a second sheet insertion passage defined between the first discharge roller unit 7 and the second discharge roller unit 8, normally because of automatic feeding.

Further, when sliding door 34 of the top cover 3 is moved to the open and closed positions, the cylindrical section 21 in the positioning element 28 of the second discharge roller unit 18 is fitted in the recess 12 in the first discharge roller unit 7. Accordingly, the second discharge roller unit 18 is moved longitudinally so that the second discharge roller unit 18 is regulated or adjusted in position. Thus, the relative position between the first discharge roller unit 7 and the second discharge roller unit 18 is decided or determined always adequately or properly.

What is claimed is:

1. A sheet discharge apparatus for a printer, comprising a printer body provided with a platen, a first discharge roller unit mounted to said printer body for defining a first sheet insertion passage at a location between said first discharge roller unit and said platen, a top cover mounted to said printer body for movement between open and closed positions, and a second discharge roller unit mounted to said top cover for defining a second sheet insertion passage at a location between said first discharge roller unit and said second discharge roller unit, wherein means cooperate to cause movement of said first discharge roller unit toward and away from said platen.

2. A sheet discharge apparatus for a printer, according to claim 1, wherein said second discharge roller unit is so mounted as to be movable longitudinally in parallel relation to said top cover, and wherein said printer body is provided with positioning means for said second discharge roller unit.

3. A sheet discharge apparatus for a printer, according to claim 1, wherein said first discharge roller unit is mounted rotatably on a pair of discharge-roller support arms, and wherein spring means extends between said discharge-roller support arms and a pair of side walls of said printer body, for biasing said first discharge roller unit away from said platen.

4. A sheet discharge apparatus for a printer, according to claim 3, wherein at least one of said discharge-roller support arms is provided with a hook element, wherein at least one of said side walls of said printer body is provided with a guide section convexly curved outwardly, and wherein said hook element is engaged with said guide section.

5. A sheet discharge apparatus for a printer, according to claim 3, wherein said first dischargeroller support arm is provided with a projection, wherein said side walls of said printer body are formed with a pair of stopper sections, respectively, and wherein said projection and said stopper section are abutted against each other to restrict an upwardly moved position of said first discharge roller unit.

6. A sheet discharge apparatus for a printer, according to claim 2, wherein said positioning means for said second discharge roller unit is formed on said first discharge-roller support arms.

7. A sheet discharge apparatus for a printer; according to claim 6, wherein said positioning means for said second discharge roller unit is a semicircular recess, and wherein said second discharge roller unit is mounted to a positioning element having a cylindrical section fitted in said recess.

8. A sheet discharge apparatus for a printer, according to claim 7, wherein said positioning element is provided with a fitting section having a slide bore, wherein said top cover has its rear face provided with a guide element, and wherein said guide element has its longitudinal width which is slightly smaller than said slide bore.

9. A sheet discharge apparatus for a printer, according to claim 8, wherein said guide element is cruciform in cross-section provided, at its four directions, with ribs.

10. A sheet discharge apparatus for a printer, according to claim 8, wherein said positioning element is formed with a longitudinal tubular section, wherein a coil spring is fitted in said longitudinal tubular section, and wherein said coil spring is arranged between a bottom of said longitudinal tubular section and a rear face of said top cover.

* * * * *